US006857401B1

(12) United States Patent
Styron

(10) Patent No.: US 6,857,401 B1
(45) Date of Patent: Feb. 22, 2005

(54) VARIABLE COMPRESSION RATIO SENSING SYSTEM FOR INTERNAL COMBUSTION ENGINE

(75) Inventor: Joshua P. Styron, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/707,755

(22) Filed: Jan. 9, 2004

(51) Int. Cl.[7] ..... F02B 75/04
(52) U.S. Cl. ..... 123/48 B; 123/78 E
(58) Field of Search ..... 123/48 B, 78 E

(56) References Cited

U.S. PATENT DOCUMENTS 4,834,031 A 5/1989 Katoh et al.
5,341,097 A * 8/1994 Wu ..... 324/207.2
6,665,605 B2 * 12/2003 Boyer et al. ..... 123/78 E
2003/0089320 A1 5/2003 Styron et al.

FOREIGN PATENT DOCUMENTS

JP 2002317663 A * 10/2002 ..... F02D/15/02

* cited by examiner

*Primary Examiner*—Noah P. Kamen

(57) ABSTRACT

A sensing system for an internal combustion engine having variable compression ratio connecting rods includes a connecting rod sensor which outputs digital signals having characteristic values corresponding to the compression ratio state of the connecting rods.

13 Claims, 5 Drawing Sheets

VARIABLE COMPRESSION RATIO SENSING SYSTEM FOR INTERNAL COMBUSTION ENGINE

This is a companion case to U.S. application Ser. No. 10/707,751, filed on Jan. 9, 2004, which is hereby incorporated by reference into this specification.

BACKGROUND OF INVENTION

1. Field of the Invention

The present invention relates to a system for determining the compression ratio at which an engine is operating. The present system is particularly adapted for use with a connecting rod for a reciprocating internal combustion engine in which the effective length of the connecting rod may be controllably varied so as to change the compression ratio of the engine.

2. Disclosure Information

Students of thermodynamics understand that, in general, higher compression ratios yield higher thermal efficiency for piston-type internal combustion engines. Unfortunately, with premixed charge engines, most commonly sold in the form of spark-ignited engines operated on gasoline, higher compression ratios may cause problems arising from preignition. This problem may be exacerbated, moreover, when an engine is turbocharged or super-charged. Therefore, it would be desirable to have an engine which can normally be operated at a higher compression ratio at most operating conditions, so as to yield maximum fuel economy, while still allowing operation at lower compression ratio at the highest power conditions. This would allow the engine to produce maximum power without knock or preignition. The inventor of the present connecting rod and compression ratio measuring system provides a unique solution to problems associated with known variable compression ratio arrangements. Such arrangements as pistons with variable compression height, typically developed by BICERI, as well as a variable plethora of other mechanical devices all suffer from problems relating to controllability, inadequate time response, excessive weight, excessive complexity, and other issues. One of the additional issues deals with the determination, in real time, of the compression ratio at which the engine is operating. U.S. Pat. No. 4,834,031 discloses a pressure sensor for determining the compression ratio of an engine by directly measuring the pressure within the combustion chamber. The system of the '031 patent is an analog device which is excessively expensive and which may suffer from ambiguities arising from the need to factor in many variables to determine the pressure range attributable to various compression ratios. The present compression ratio measuring system, which is mated to a variable length connecting rod, solves the problems associated with prior compression ratio controlling devices by using a robust digital device which produces a signal having a variable duration which is clearly linked to the compression ratio at which the engine is operating.

SUMMARY OF INVENTION

A variable compression ratio sensing system for an internal combustion engine having a crankshaft and one or more reciprocating pistons includes variable compression ratio connecting rod for attaching said crankshaft to said piston, with said connecting rod having a plurality of discrete compression ratio states, and a digital output sensor for producing a signal having a variable duration corresponding to the particular compression ratio state of the connecting rod.

According to an aspect of the present invention, a digital output sensor for a variable compression ratio sensing system may comprise a Hall Effect sensor producing a longer signal when the compression ratio is at one value, and a shorter signal when the compression ratio is at another value. In a preferred embodiment, a Hall Effect sensor is mounted proximate an end of the connecting rod which is attached to the crankshaft of the engine.

According to another aspect of the present invention, avariable compression ratio connecting rod has a small end attached to a piston and a large end attached to a crankshaft, with the large end sweeping through a space as the crankshaft rotates, with the space having a boundary which is determined by the compression ratio state of the connecting rod. In effect, the large end of the connecting rod sweeps through an orbit, with the orbit having a center which is closer to the centerline of the crankshaft when the connecting rod is in a first compression ratio state and farther from the centerline of the crankshaft when the connecting rod is in a second compression ratio state. In the particular embodiment described herein the large end sweeps through an orbit having a center which is closer to the centerline of the crankshaft when the connecting rod is in a higher compression ratio state and farther from the centerline of the crankshaft when the connecting rod is in a lower compression ratio state.

According to another aspect of the present invention, an engine controller receives inputs from a number of engine operating parameter sensors, including at least a crankshaft position sensor for producing a crankshaft position signal, with the controller using the outputs of the crankshaft position sensor and the compression ratio sensor to determine the compression ratio state of the connecting rod.

According to another aspect of the present invention, a method for determining a compression ratio operating state of a reciprocating internal combustion engine includes the steps of sensing the operating speed of the engine, sensing the duration of a compression ratio state signal, and using the sensed operating speed and the sensed compression ratio state signal duration to determine the compression ratio at which the engine is operating. This method is particularly useful where the engine has a variable compression ratio connecting rod and a Hall Effect sensor associated with the connecting rod, with the Hall Effect sensor being fixedly placed in proximity of the connecting rod's large end such that the Hall Effect sensor has an output signal with a duration which is dependent upon the compression ratio state of the connecting rod.

It is an advantage of the present connecting rod that an engine compression ratio may be measured or determined in a robust manner so as to enable excellent control of the compression ratio of the engine.

It is a further advantage of the present invention that the present connecting rod allows provision of compression ratio control with less system weight and less complexity as compared with prior art mechanisms.

It is a further advantage of the present invention that the present connecting rod based compression ratio detecting system needs only a digital input, rather than a more costly analog input, for use with an engine control computer.

Other advantages, as well as objects and features of the present invention, will become apparent to the reader of this specification.

DETAILED DESCRIPTION

Figure 1:
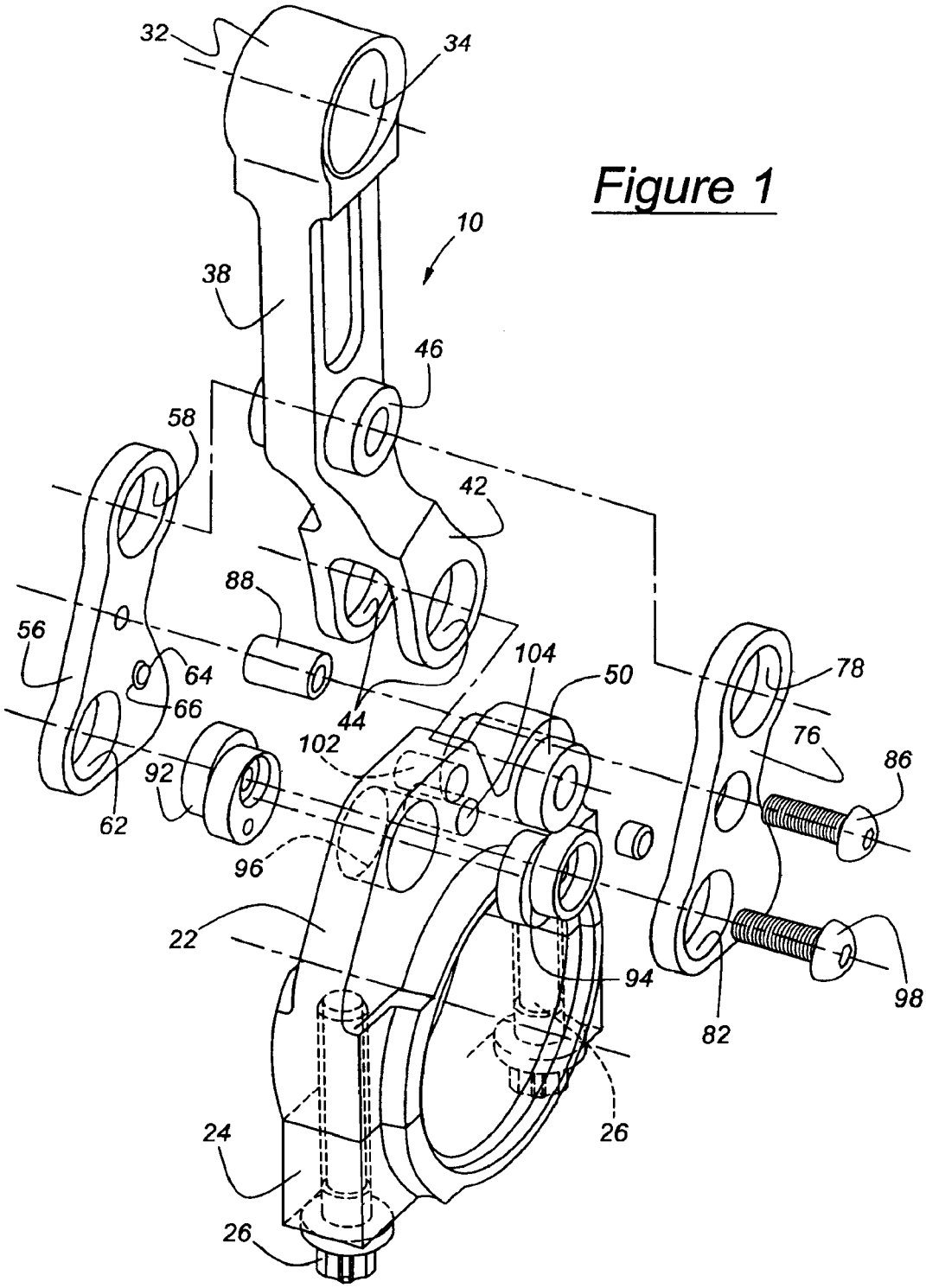
FIG. 1 is an exploded perspective view of a connecting rod which may be used with a compression ratio sensing system according to the present invention.

As shown in FIG. 1, connecting rod 10 according to the present invention has large end 22 adapted for attachment to crankshaft 6 (shown in FIG. 2) of an engine, and small end 32 having a wrist pin bore 34 for attaching connecting rod 10 to an engine piston (not shown). Connecting rod cap 24 and screws 26 maintain connecting rod 10 in contact with a crankshaft journal in conventional fashion.

Primary link 38 extends between small end 32 and large end 22. One end of primary link 38 is integral with small end 32, and the other end 42 comprises a fork with two bores 44 which accept pin 50 so as to allow primary link 38 to be pivotably attached to large end 22. Primary link 38 comprises one part of a four-bar link system extending between small end 32 and large end 22. The second portion of the four-bar link is comprised by an adjustable toggle link which is formed by low compression link 56 and high compression link 76. Beginning now with low compression link 56, it is seen from FIG. 1 that link 56 has a primary link engaging bore 58 which allows pivotal mounting upon pivot 46, which is mounted within primary link 38. This allows the adjustable toggle link to be pivotably attached to primary link 38. The second end of low compression link 56 has a bore 62 which permits mounting upon eccentric 92 which is housed within large end 22 of connecting rod 10. Eccentric 92 is mounted within a bore 96 formed in large end 22.

As shown in FIG. 1, large end 22 has two bores, 102 and 104, which comprise low compression lock pin bore 102 and high compression lock pin bore 104. Oil arising from a passage in the crankshaft (not shown) and coming through a drilling in the crank journal at the edge of the bearing insert within large end 22 will proceed through passages and into bores 104 and 102. Pressurized oil will cause the lock pin housed within bore 102 to be retracted, while at the same time the lock pin housed within bore 104 will be extended, so as to engage high compression link 76 (FIG. 1). As with low compression link 56, high compression link 76 is pivotably attached to pivot post 46 on primary link 38 and is also pivotably attached to eccentric 94, Which is housed within bore 96 in large end 22. Screws 86 and 98 serve to mount high compression link 76 to low compression link 56. Screw 98 serves to attach the two eccentric halves 92 and 94. Details of the oil supply system are shown in U.S. Pat. No. 6,408,804, which is assigned to the assignee of the present invention, and which is hereby incorporated by reference, in its entirety, into this specification.

Figure 2:
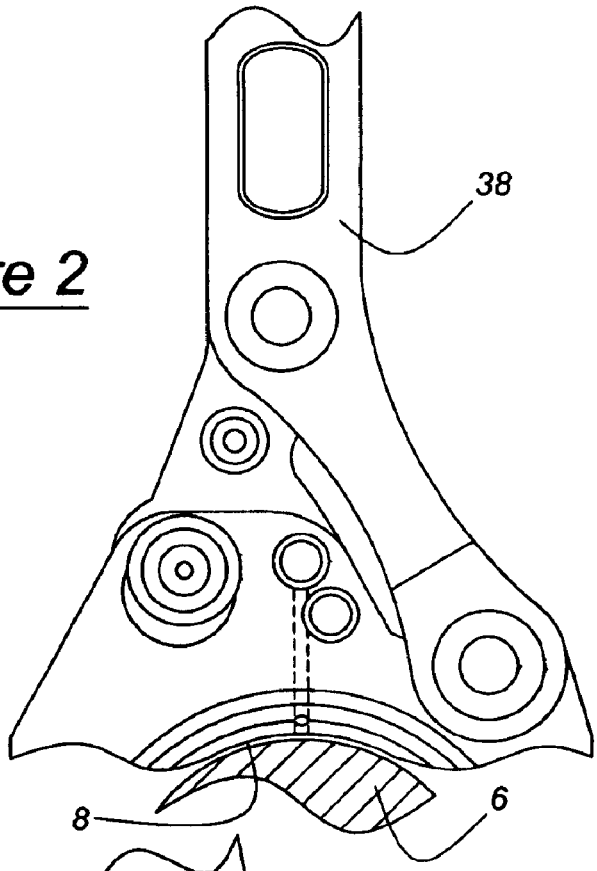
FIG. 2 is a partially schematic representation of the connecting rod shown in FIG. 1, shown in a high compression ratio state.
Figure 3:
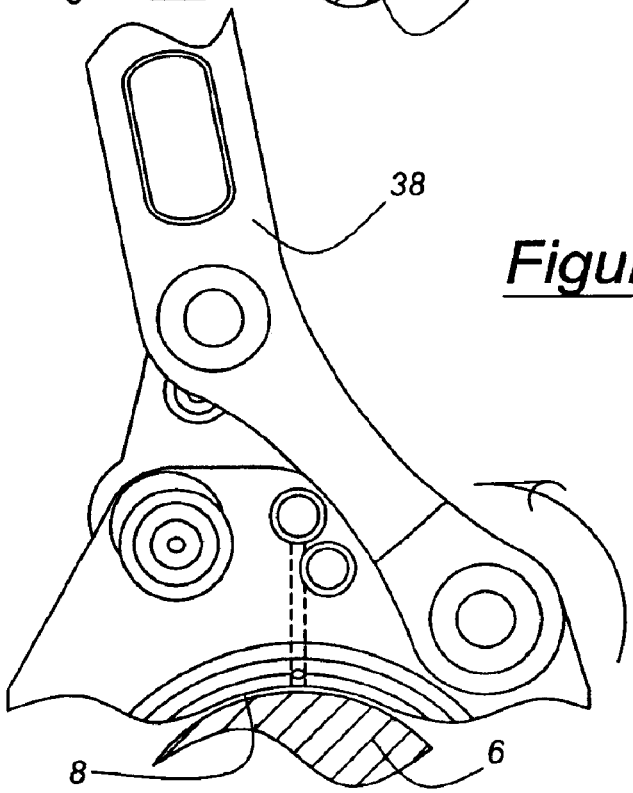
FIG. 3 is a partially schematic representation of the connecting rod shown in FIG. 1, shown in a low compression ratio state.

FIGS. 2 and 3 show the manner in which the configuration of connecting rod 10 changes as the connecting rod moves from a higher compression state to a lower compression state. In FIG. 2, primary link 38 is positioned such that the distance between the center of bore 8 (the large end bore) and the center of bore 34 (the small end bore) is at a maximum. In FIG. 3, however, primary link 38 is rotated with respect to large end 22 such that the distance between bores 8 and 34 is at a minimum. Thus, the resulting compression ratio is at a minimum. These compression ratio changes are accompanied by rotation of large end 22 about crankpin 6, and this rotation can be used in conjunction with Hall Effect sensor 140 to determine the phase shift resulting from the compression ratio state change.

Figure 4:
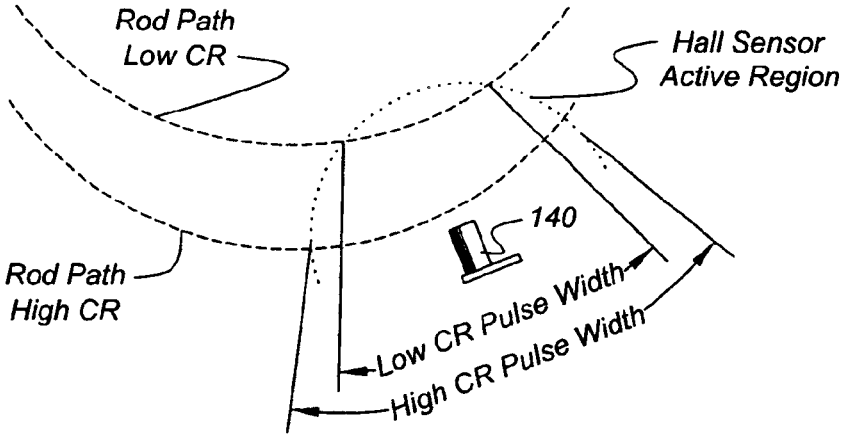
FIG. 4 illustrates a portion of the orbital trajectories of the large end of the connecting rod of FIG. 1, corresponding to low and high compression ratio operating states.

The geometry of connecting rod 10 is such that the boundary of the space through which large end 22 sweeps as crankshaft 6 rotates changes as the compression ratio is adjusted. This is shown in FIG. 4. Thus, when connecting rod 10 is operating at a high compression ratio state, large end 22 sweeps through an orbit having a radius which is greater than the radius associated with the lower compression ratio state. As shown in FIG. 4, this geometrical change causes the pulse width of the output of sensor 140 to change. Thus, the pulse width indicates whether connecting rod 10 is operating in a higher compression state or a lower compression state. This is particularly useful for the case in which a single connecting rod 10 is attached to a single crankshaft journal. Those skilled in the art will appreciate in view of this disclosure that as an alternative, controller 500 (FIG. 7) may measure the phase shift of the sensor's output with respect to the crankshaft's position. This may be accomplished, for example, by positioning Hall Effect sensor 140 such that the sensor will be triggered by one of the tabs 35 shown in FIG. 5. By marking the location of the crankshaft whenever the Hall Effect sensor is triggered, the change in phase between the crankshaft position and the Hall Effect signal will readily disclose the compression ratio operating state. Thus, the timing of the Hall Effect pulse, and not its duration, may be used to determine the compression ratio operating state. FIG. 8 shows the signal generated by a single sensor observing two connecting rods side by side. The falling edge phase tracks one rod's position, while the phase of the rising edge tracks the other rod's position. The pulse duration may also be used to determine if both rods are in the high compression state, or the low compression state, or if the rods are in opposite states.

Figure 5:
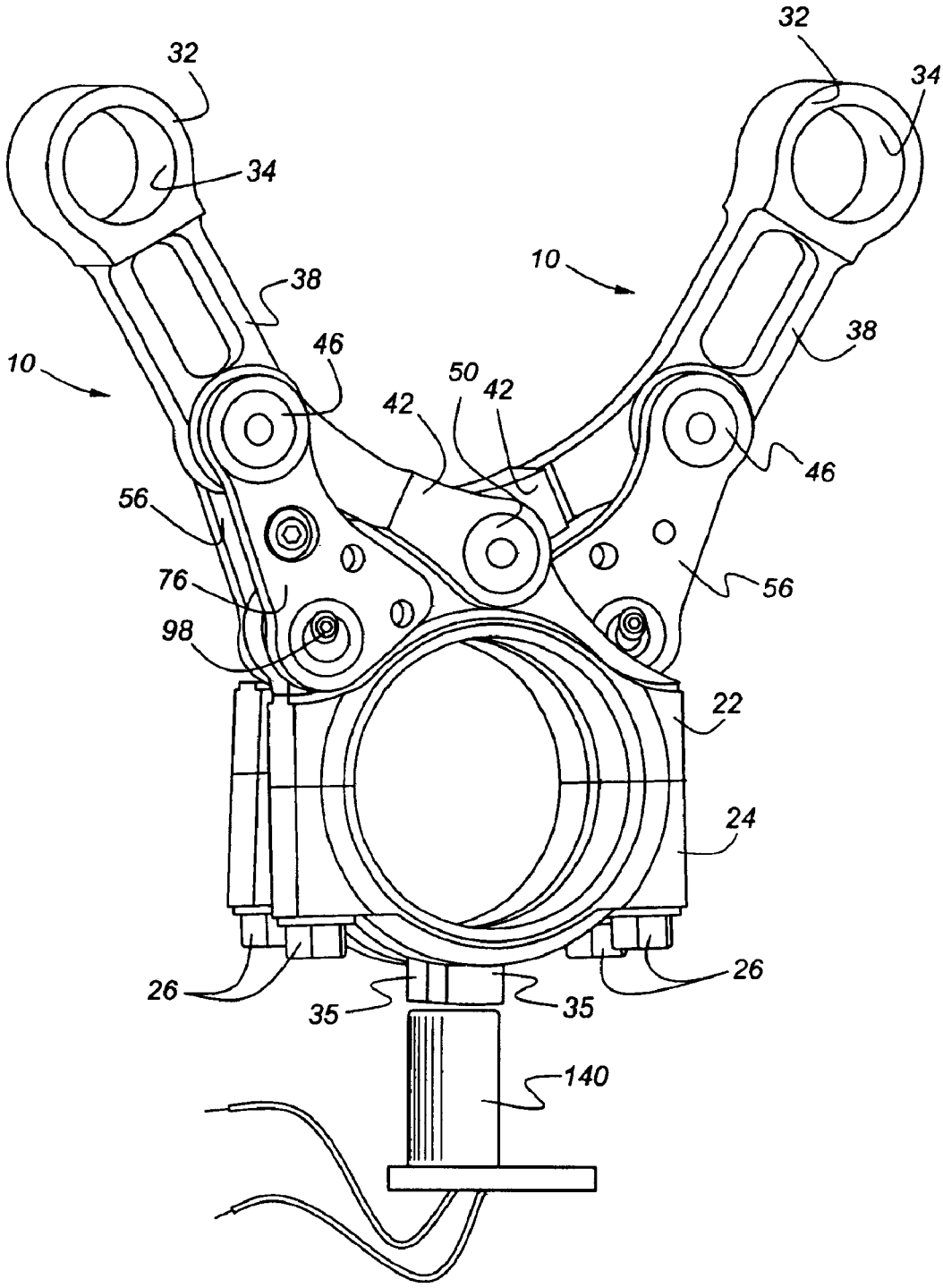
FIG. 5 shows a pair of variable compression ratio connecting rods in a low compression ratio operating state.
Figure 6:
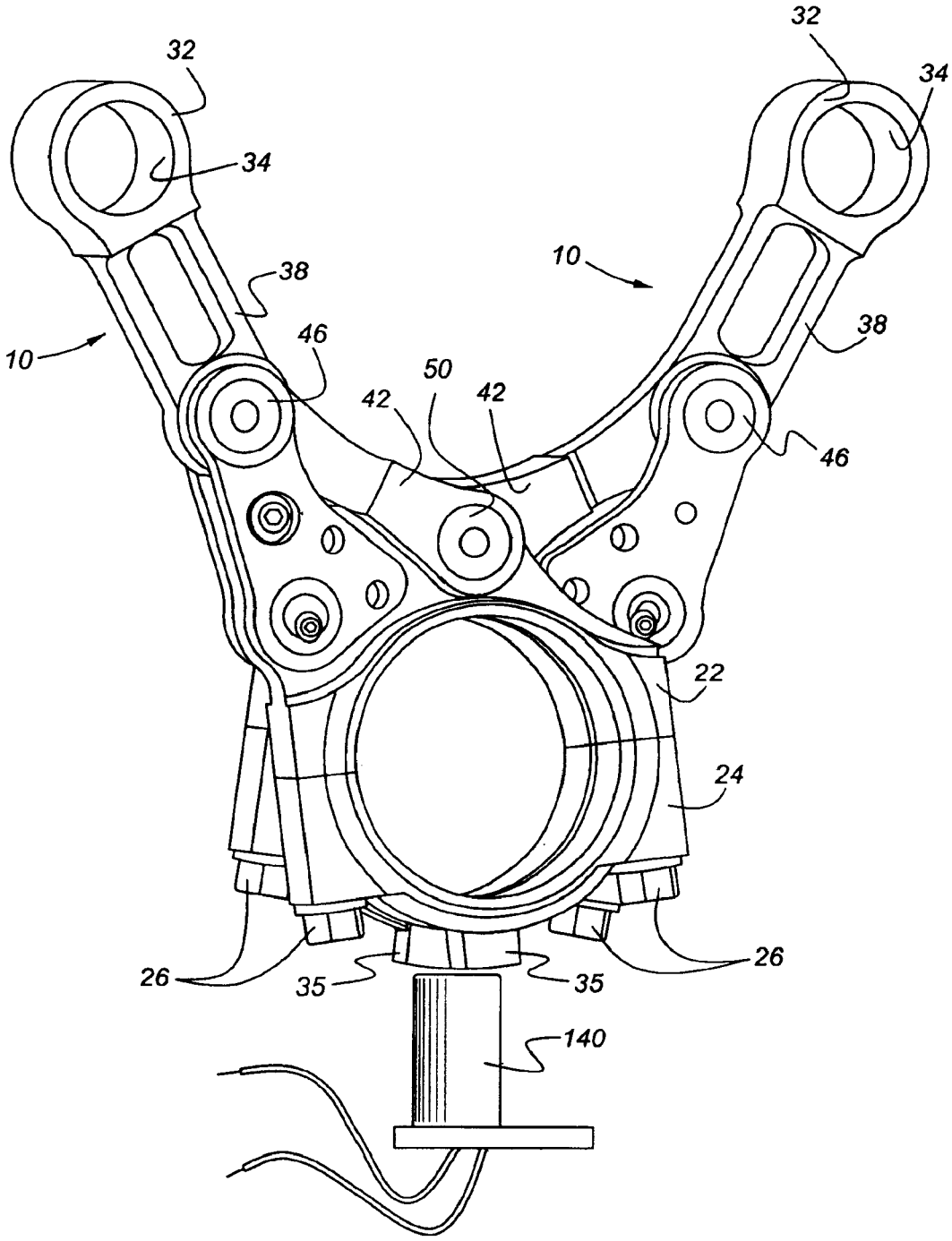
FIG. 6 shows the connecting rods of FIG. 5 in a high compression ratio operating state.

The case of multiple connecting rods 10 attached to crankshaft 6 is shown in FIGS. 5 and 6. The connecting rods of FIG. 5 are operating in a lower compression state, and this means that tabs 35, which depend from large ends 22, are in a converged configuration. The pulse from sensor 140 therefore has the shape shown in FIG. 8 as trace "LCR". In FIG. 6, connecting rods 10 are in the high compression state, and tabs 35 are splayed apart. The resultant pulse is labeled in Fig. as "HCR". The traces labeled "MIX 1" and "MIX 2" correspond to cases in which one of connecting rods 10 is in the HCR mode and the other rod is in the LCR mode. In either case, engine controller 500 (FIG. 7) will set a malfunction flag and attempt to use connecting rod actuator 506 to set connecting rods 10 to a default lower compression ratio state. It is easily seen from FIG. 8 that connecting rod sensor 140 produces a unique signal for each of the possible connecting rod compression ratio states. This is important for the purpose of on board diagnostic (OBD) routines.

Figure 7:
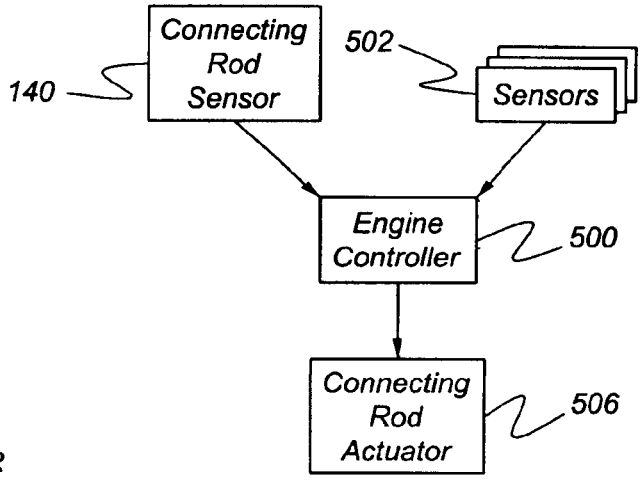
FIG. 7 is a block diagram illustrating one aspect of the present invention.
Figure 8:
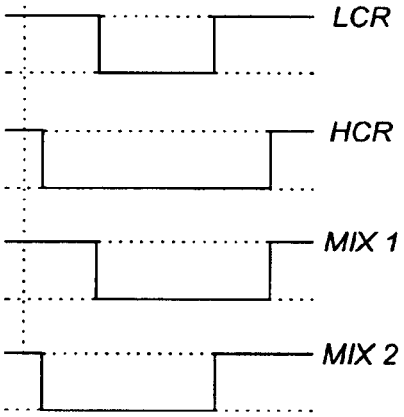
FIG. 8 illustrates a number of unique sensor signals corresponding operation at low, high, and mixed compression ratio states.

Engine controller 500 receives inputs from a number of sensors, shown at 502 in FIG. 7, including such sensors as those relating to crankshaft position, engine speed, camshaft position, engine coolant and ambient temperatures, throttle position, intake manifold pressure, and other engine operating parameters. The output of these sensors allows controller 500 to sense both the operating speed of the engine and the duration and phasing of the compression ratio state signal. These sensed values will be used to determine the compression ratio operating state of the engine, which may be controlled by means of connecting rod actuator 506. In the case illustrated herein, connecting rod actuator 506 comprises the four-bar link system described herein and the valving and associated hardware described in U.S. Pat. No. 6,408,804, which has been incorporated by reference into this specification.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. A variable compression ratio sensing system for an internal combustion engine having a crankshaft and at least one reciprocating piston, with said sensing system comprising:

a variable compression ratio connecting rod for attaching said crankshaft to said at least one piston, with said connecting rod having a plurality of discrete compression ratio states; and a digital output sensor for producing a signal having a value corresponding to the particular compression ratio state of said connecting rod, with said sensor comprising a Hall Effect sensor, with said sensor generating a longer duration signal corresponding to a high compression ratio state and a shorter duration signal corresponding to a low compression ratio state.

2. A variable compression ratio sensing system according to claim 1, wherein said connecting rod has a small end attached to said piston and a large end attached to said crankshaft, with said large end sweeping through a space as said crankshaft rotates, with said space having a boundary which is determined by the compression ratio state of said connecting rod.

3. A variable compression ratio sensing system according to claim 2, wherein said large end sweeps through an orbit, with said orbit having a radius which is closer to the centerline of said crankshaft when said connecting rod is in a first compression ratio state and father from the centerline of said crankshaft when said connecting rod is in a second compression ratio state.

4. A variable compression ratio sensing system according to claim 3, wherein said large end sweeps through an orbit having a radius which is closer to the centerline of said crankshaft when said connecting rod is in said low compression ratio state and farther from the centerline of said crankshaft when said connecting rod is in said high compression ratio state.

5. A variable compression ratio sensing system according to claim 1, wherein said Hall Effect sensor, generates a signal having a unique phase with respect to the rotational position of the crankshaft for each compression ratio state.

6. A variable compression ratio sensing system according to claim 1, wherein said Hall Effect sensor is mounted proximate an end of said connecting rod attached to said crankshaft.

7. An internal combustion engine having a variable compression ratio sensing system, with said engine having a crankshaft with at least one reciprocating piston, and with said sensing system comprising:

an engine controller;

a plurality of engine operating parameter sensors operatively connected with said engine controller, with said sensors including at least a crankshaft position sensor for producing a time-based crankshaft position signal;

a connecting rod for attaching said crankshaft to said at least one piston, with said connecting rod having at least one higher compression ratio state and at least one lower compression ratio state; and a digital output sensor for producing a compression ratio signal having a duration corresponding to the compression ratio state of said connecting rod, with said engine controller using said crankshaft position signal and said compression ratio signal to determine the compression ratio state of said connecting rod.

8. An engine according to claim 7, wherein said digital output sensor comprises a Hall Effect sensor.

9. An engine according to claim 7, having a plurality of variable compression ratio connecting rods, with said digital output sensor comprising a Hall Effect sensor positioned proximate a plurality of said connecting rods, so as to generate a longer duration signal in the event that the connecting rods are operating in a higher compression ratio state, with said Hall Effect sensor generating a shorter duration signal in the event that the connecting rods are operating in a lower compression ratio state.

10. An engine according to claim 7, having a plurality of variable compression ratio connecting rods, with said digital output sensor comprising a Hall Effect sensor positioned proximate a plurality of said connecting rods, so as to generate unique signals corresponding to operation in a higher compression ratio state, operation in a lower compression ratio state, and operation with said connecting rods at mixed compression ratio operating states.

11. A method for determining a compression ratio opening state of a reciprocating internal combustion engine, comprising the steps of:

sensing the operating speed of the engine;

sensing the duration of a compression ratio state signal;

using said sensed operating speed and said sensed compression ratio state signal duration to determine the compression ratio at which the engine is operating.

12. A method according to claim 11, wherein said engine has a variable compression ratio connecting rod and a Hall Effect sensor associated with said connecting rod, with said Hall Effect sensor being placed into proximity to said connecting rod such that the Hall Effect sensor has an output signal with a duration which is dependent upon the compression ratio state of said connecting rod.

13. A method according to claim 12, wherein said Hall Effect sensor is placed proximate a large end of said connecting rod, which is attached to the crankshaft of said engine, with said large end of said connecting rod describing an orbit which shifts according to the particular compression ratio at which said connecting rod is being operated.

* * * * *